US005404679A

United States Patent [19]

Friel et al.

[11] Patent Number: 5,404,679

[45] Date of Patent: Apr. 11, 1995

[54] PORTABLE MANUAL SHARPENER FOR KNIVES AND THE LIKE

[75] Inventors: Daniel D. Friel, Greenville; Samuel Weiner, Wilmington, both of Del.

[73] Assignee: Edgecraft Corporation, Avondale, Pa.

[21] Appl. No.: 901,213

[22] Filed: Jun. 18, 1992

Related U.S. Application Data

[60] Continuation-in-part of Ser. No. 867,325, Apr. 13, 1992, Pat. No. 5,245,791, which is a division of Ser. No. 636,399, Dec. 31, 1990, Pat. No. 5,148,634, which is a continuation-in-part of Ser. No. 396,974, Aug. 22, 1989, Pat. No. 5,005,319, which is a continuation-in-part of Ser. No. 304,323, Jan. 31, 1989, Pat. No. 4,897,965, which is a continuation-in-part of Ser. No. 917,601, Oct. 6, 1986, Pat. No. 4,807,399, which is a continuation-in-part of Ser. No. 588,794, Mar. 12, 1984, Pat. No. 4,627,194, and a continuation-in-part of Ser. No. 855,147, Apr. 23, 1986, Pat. No. 4,716,689, which is a continuation-in-part of Ser. No. 588,795, Mar. 12, 1984, abandoned.

[51] Int. Cl.[6] ..... B24B 21/00

[52] U.S. Cl. ..... 451/312; 451/557; 451/558

[58] Field of Search ..... 51/149, 156–159, 51/204, 205 R, 205 WG, 211 R, 211 H, 214, 220, 221 R, 221 BS, 128, 190 BS, 158, 2.10, 2.14, 285; 76/82, 82.2, 84, 88, 89, 86

[56] References Cited

U.S. PATENT DOCUMENTS

| | | | |
|---|---|---|---|
| 577,991 | 3/1897 | Strong | 76/88 |
| 730,706 | 6/1903 | Rose | 76/88 |
| 1,181,161 | 5/1916 | Perry | 51/285 |
| 1,451,526 | 4/1923 | Bowles | 76/86 |
| 2,448,629 | 9/1948 | Schmidt | 76/88 |
| 2,547,714 | 12/1948 | Pan Coast | 51/214 |
| 2,775,075 | 12/1956 | McMaster et al. | 51/128 X |
| 2,841,926 | 7/1958 | Lebus | 51/128 |
| 3,052,068 | 9/1962 | Burgess | 51/214 |
| 3,332,173 | 7/1967 | McMaster et al. | 51/128 |
| 3,334,446 | 8/1967 | Jager | 51/128 |
| 3,381,417 | 5/1968 | Eckstein | 51/128 |
| 3,575,068 | 4/1971 | Stafford | 76/82.2 |
| 4,494,340 | 1/1985 | Carter | 76/82 X |
| 4,502,254 | 3/1985 | Carter | 51/214 |
| 4,672,727 | 6/1987 | Dunkin | 51/128 |

FOREIGN PATENT DOCUMENTS

| | | | |
|---|---|---|---|
| 2519205 | 11/1976 | Germany | 76/82 |
| 269579 | 7/1950 | Switzerland | 51/128 |
| 213520 | 7/1984 | United Kingdom . | |

*Primary Examiner*—M. Rachuba
*Attorney, Agent, or Firm*—Connolly & Hutz

[57] ABSTRACT

A portable manual sharpener for cutting tools such as knives, scissors and the like includes a base having a first stage sharpening station which includes a stationary non-rotatable support member with an abrasive coated planar surface on opposite sides of the support member. A pair of symmetrical slots are disposed adjacent to the planar faces with a guide surface located in each slot at a predetermined angle to the planar surface. A hold down device maintains the cutting blade in contact with the guide surface as the blade is moved through the sharpening station with the cutting edge facet of the blade in sliding contact with the abrasive particles on the planar face. The base includes an area which can be conveniently hand held.

17 Claims, 2 Drawing Sheets

PORTABLE MANUAL SHARPENER FOR KNIVES AND THE LIKE

Cross-Reference to Related Applications

This application is a continuation in part of application Ser. No. 07/867,325 filed Apr. 13, 1992 now U.S. Pat. No. 5,245,791, which in turn is a division of application Ser. No. 636,399, now U.S. Pat. No. 5,148,634, filed Dec. 31, 1990, which is a continuation-in-part of application Ser. No. 396,974 filed Aug. 22, 1989, now U.S. Pat. No. 5,005,319 which in turn is a continuation-in-part of application Ser. No. 304,323 filed Jan. 31, 1989, now U.S. Pat. No. 4,897,965 which is a continuation-in-part of application Ser. No. 917,601 filed Oct. 6, 1986, now U.S. Pat. No. 4,807,399 which is a continuation-in-part of application Ser. No. 588,794 filed Mar. 12, 1984, now U.S. Pat. No. 4,627,194 and application Ser. No. 855,147 filed Apr. 23, 1986, now U.S. Pat. No. 4,716,689 which is a continuation-in-part of application Ser. No. 588,795 filed Mar. 12, 1984 now abandoned.

BACKGROUND OF THE INVENTION

The above indicated parent patents and applications, the details of which are incorporated herein by reference thereto, relate to various techniques for sharpening cutting tools, such as knives, scissors and the like. These techniques generally involve the use of at least one stage and preferably multi-stage sharpening sections wherein each section includes a sharpening member having a pair of abrasive coated faces on opposite sides of the sharpening member. A guide surface which may be in the form of a magnetic guide is provided at a predetermined angle to each abrasive coated surface. The angle for the two guide surfaces of a station would be the same predetermined angle, but that angle would differ in each successive stage sharpening section. Where for example, three stages are provided the first stage acts as a presharpening section and the later two stages act as honing sections which progressively increase the angle of the cutting edge facet of the blade.

The primary emphasis in the above parent patents and applications relates to a moving sharpening member which either rotates or is orbitally driven. The sharpeners made in accordance with the parent patents and applications have been extremely successful in producing very sharp edges where commercial sharpeners have practiced the inventions of the parent patents and applications.

Despite the effectiveness of the sharpeners made in accordance with the above parent patents and applications it would also be desirable if a manual portable sharpener could be provided for use, for example, in remote areas where there is no electricity to drive the sharpening members.

SUMMARY OF THE INVENTION

An object of this invention is to provide a portable manual sharpener for cutting tools such as knives and the like which is capable of being used without the need for electricity.

A further object of this invention is to provide such a sharpener wherein the sharpening member is stationarily mounted and the cutting blade is manually moved through each stage sharpening section.

In accordance with this invention a portable manual sharpener for knives and the like includes a base having a first stage sharpening section which in turn includes support means having oppositely disposed abrasive covered planar faces. The abrasives preferably are diamonds but other abrasives can be employed with lesser efficiency. Symmetrical slots are provided in the sharpening station on each side of the support means with guide means mounted at each slot. Each guide means includes a guide surface disposed at a predetermined angle to its abrasive coated planar face and terminates in an edge substantially juxtaposed the planar face. Where more than one stage sharpening station is used the same angle preferably would be used for each slot within a stage, but each stage would have a different angle than the other stages. Where there is only one pair of slots it is of course possible to use a different angle and grit in each slot and to operate the sharpener by working from both sides of the sharpener in order to sharpen the left and right facets alternately through the same slot.

In the preferred practice of the invention hold down means are provided to maintain the blade in contact with the guide surface as the blade is moved through the sharpening station with its cutting edge facet in sliding contact with the abrasive particles on the planar face. The hold down means may include magnetic means as in the parent patents and applications or spring means. In the preferred practice of the invention rollers are provided on each side of the guide surface to facilitate sliding the blade during sharpening.

In the preferred practice of the invention the base also includes a handle to facilitate the portability of the sharpener.

THE DRAWINGS

DETAILED DESCRIPTION

Figure 2:
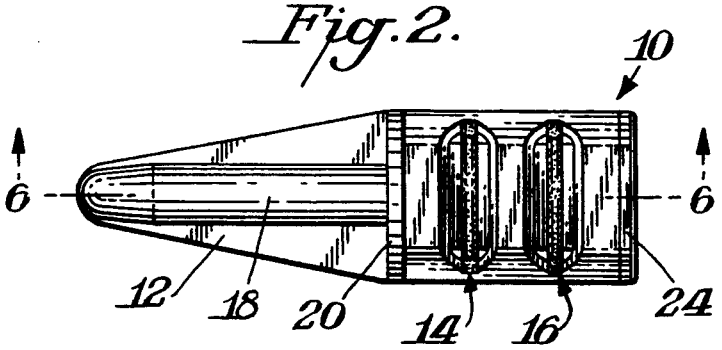
FIG. 2 is a top plan view of the sharpener shown in FIG. 1.
Figure 3:
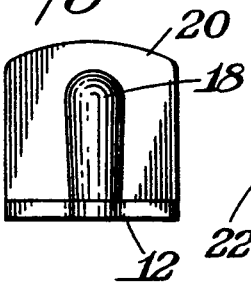
FIGS. 3–4 are end elevational views of the sharpener shown in FIGS. 1–2.

As indicated above the various parent patents and applications are based upon sharpening methods using magnetic guides and either orbiting and/or rotary motion of the abrasive covered sharpening member. In the course of research on those inventions there became an awareness of the possibility of using similar principles with static or non-moving sharpening members. Subsequent work surprisingly revealed that even where there is no movement to the sharpening member it is possible to create fine blade edges with static abrasives, although the edges are not as perfect as those obtained where, for example, there is orbiting abrasive motion. The edges, however, obtained with static sharpening members are still very sharp and also quite durable, particularly if created by two or three stages of such sharpening each at progressively larger angles. The performance is significantly better if diamonds are used as the abrasive because of their hardness and surprisingly superior metal cutting ability and freedom from loading with sharpening debris. A sharpener utilizing static sharpening members would be particularly useful where there is a need for a portable sharpener as in remote areas having no electricity.

In general, the sharpener of this invention would have one or more sharpening stages. FIGS. 1–6, for example, illustrate one practice of the invention wherein the sharpener 10 includes a base 12 with a first stage sharpening section 14 and a second stage sharpening section 16. It is to be understood that although two stages are illustrated the invention may be broadly practiced where there is only one stage or where there are more than two stages. The base 12 may be considered as divided into two sections. One section is the operating section which includes the sharpening stations 14,16. The adjacent section is the handle section which includes a handle 18 mounted to a vertical plate 20 with the downwardly bent end 22 of the handle secured to base 12. As later described, the operating section would be mounted between central plate 20 and end plate 24.

Figure 1:
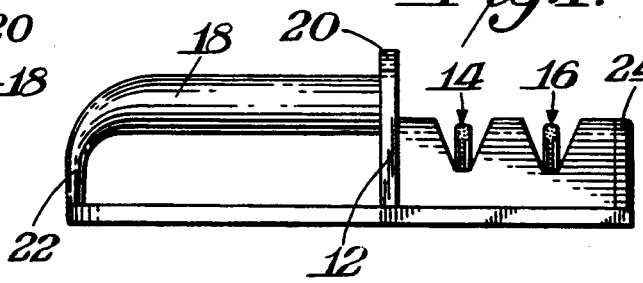
FIG. 1 is a side elevational view of a portable manual sharpener in accordance with this invention.
Figure 4:
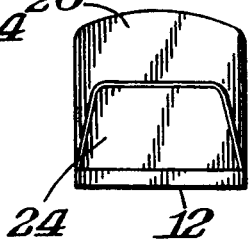
Figure 5:
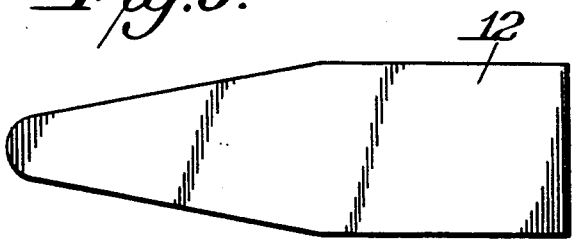
FIG. 5 is a bottom plan view of the sharpener shown in FIGS. 1–4.

As best illustrated in FIG. 1 handle 18 is disposed above the flat upper surface of base 12 to provide adequate clearance for the fingers of the user so that the sharpener 10 may be easily carried. Additionally, the handle permits the user to provide stability to sharpener 10 by holding the handle with one hand while the other hand moves the cutting blade through each sharpening station. The flat exposed upper surface of base 12 additionally provides a convenient location on which clamps may be secured to mount sharpener 10 to a work surface so that sharpener 10 would be mounted in a fixed clamped condition during the sharpening operation without the necessity for applying manual force to hold sharpener 10 stationary if a more stable mounting should be desired.

Figure 6:
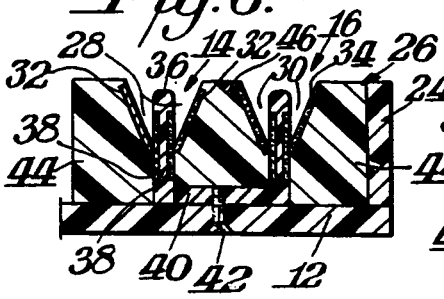
FIG. 6 is a cross-sectional view taken through FIG. 2 along the line 6—6.

FIG. 6 illustrates one embodiment for practicing the concepts of this invention. As shown therein the operating section may be considered as being in the form of a block 26 wherein a first pair of symmetrical slots 28,28 is formed in sharpening station 14 while a second pair of symmetrical slots 30,30 is formed in sharpening station 16. As illustrated, the angle of each slot 28,28 is less than the angle of slots 30,30. A magnetic guide surface 32,34 is provided at each of the respective angles.

Each sharpening station 14,16 is provided with a sharpening member 36 having a pair of oppositely disposed planar faces covered with abrasive particles 38.

For the sake of convenience, sharpening members 36,36 comprise the vertical legs of a U-shaped mount 40 which is secured to base 12 by a suitable fastener 42. End block members 44,44 would be permanently mounted to base 12 while intermediate block member 46 would be detachably mounted should it be necessary to replace the sharpening members 36,36. If desired, the same fastener 42 may be utilized to secure both the mounting member 40 and the intermediate block member 46 to base 12. Thus, during assembly and for replacement purposes fastener 42 would be detached from base 12. Mounting member 40 would then be inserted into the space between end block members 44,44. Intermediate block member 46 would then be inserted between the pair of sharpening members 36,36 and fastener 42 would then be utilized to secure mounting member 40 and intermediate block member 46 to base 12. Where more than two sharpening stations are used, the required number of sharpening members would be provided either separately or on a common mounting member similar to U-shaped mounting member 40 with the appropriate number of intermediate block members between each pair of adjacent sharpening members.

FIG. 6 illustrates the guide surface 32 to be in the form of a magnet similar to that disclosed in parent U.S. Pat. Nos. 4,716,689 and 5,005,319.

Figure 7:
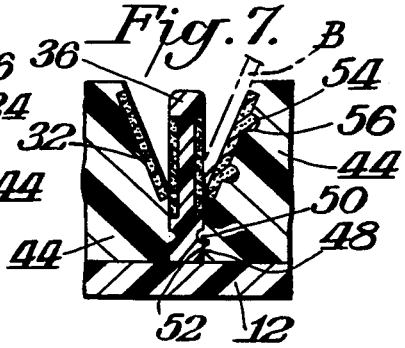
FIG. 7 is a cross-sectional view similar to FIG. 6 showing a modified form of sharpening station in accordance with this invention.

FIG. 7 illustrates variations of a sharpening station. As shown therein, the sharpening member 36 is individually mounted to base 12 rather than being mounted on a common mounting member, such as mounting member 40 of FIG. 6. The individual mounting could be accomplished in any suitable manner, such as by providing a slot 48 between base sections 44,44 with the lower portion of sharpening member 46 having a groove 50 for receiving protrusions 52 in block members 44,44. Sharpener 36 may thus either be snapped into the slot or could be slid into the slot and then mounted in place by a side plate or other suitable mounting structure. The complementary shapes of the slot and sharpening member 36 assure holding sharpening member 36 in its proper location.

A further feature illustrates in FIG. 7 is the use of projections 54 on the inner side of magnet 32 to snap into corresponding openings 56 in block members 44 so as to permit detachability of magnets 32. It is to be understood that although only one of the magnets 32 is illustrated as having the detachable mounting, such detachable mounting could be provided for any and all magnets. FIG. 7 illustrates the blade B in its sharpening position.

Figure 8:
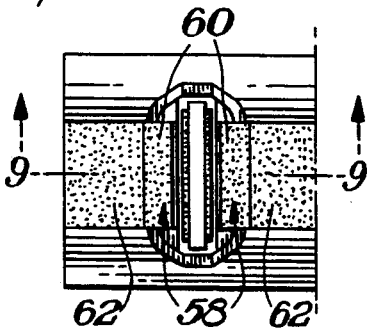
FIG. 8 is a top plan view of yet another form of sharpener in accordance with this invention.
Figure 9:
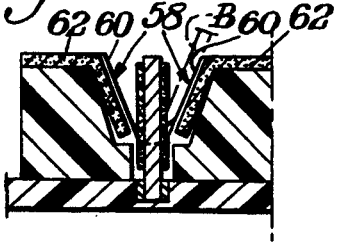
FIG. 9 is a cross-sectional view taken through FIG. 8 along the line 9—9.

FIGS. 8–9 illustrate a further variation of the invention wherein the magnetic guide surface 58 is a bi-level magnet of the type illustrated and described in parent U.S Pat. No. 4,897,965. Bi-level magnet 58 would include an inclined surface 60 and a horizontal surface 62.

Figure 12:
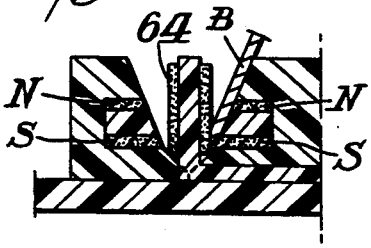
FIG. 12 is a cross-sectional view in elevation of yet another form of sharpening station in accordance with this invention.

FIG. 12 illustrates the magnetic guide surface 64 to be of the type shown and described in parent U.S. Pat. No. 4,627,194.

The use of magnetic guides as described above and in the parent patents works exceedingly well to control accurately the sharpening angle, to control the sharpening pressure and to help minimize the amount of sharpening debris remaining on the abrasive surface in use. The magnetic guides such as in U.S. Pat. No. 4,897,965 and illustrated in FIGS. 8–9 are particularly desirable in that they are applicable to knives of a variety of sizes, such as pocket knives, filet knives, boning knives, paring knives and chef's knives.

Although magnetic guides are preferable in the practice of this invention it has also been discovered that surprisingly one can still improve edges, albeit not as well, by omitting the magnetic attractive forces and depending solely on the manual skill to control the angle, pressure, etc. in a physical arrangement such as illustrated in the various figures where there would be a planar guide surface, but the guide surface would not include any magnets. In such arrangements, good edges could be obtained where special care is taken to control the angle of the blade B against the abrasive particles by leaning and steadying the blade against the physical guide on each stroke. Thus, the invention could be practiced without the use of magnets as a hold down means for the blade. The invention, however, is preferably practiced with some form of hold down means, such as the magnets or various other types of hold down means. It is very important to use diamonds as the abrasive in such configurations in order to obtain optimum performance.

Figure 14:
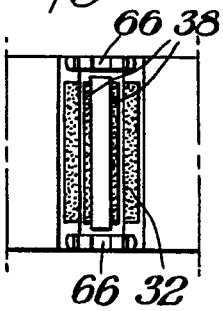
FIG. 14 is a top plan view of the sharpener shown in FIG. 13.
Figure 13:
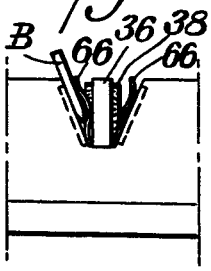
FIG. 13 is a side elevational view of still yet another form of sharpening station in accordance with this invention.

FIGS. 13–14 illustrate the use of alternative hold down means. As shown therein spring clips 66 are mounted at each end of the guide surface beyond the lateral projection of abrasive surface 38 to further aid the operator to steady the blade B against the guide. The spring clips may take any suitable form, such as the illustrated leaf springs.

The use of spring clips, particularly where the guide surface is not a magnet, is preferred. Diamonds are the preferable abrasive particles since diamonds cleanly remove sufficient quantities of metal to permit sharpening in a reasonably short time. Although other abrasives may work, other abrasives will not remove metal as fast or as efficiently as diamonds and other abrasives tend to "load-up" faster with sharpening debris, thus further reducing their effectiveness or interfering with the creation of good edges.

Even without the use of magnets the physical design which involves symmetrical slots on each side of the abrasive surfaces is important in order to create symmetrical facets forming the blade edge. By sharpening on alternate strokes on the left and the right of the blade, the facets are abraded equally and the edges formed essentially in the center of the blade thickness. The use of diamond abrasives is important to assure clean and equal sharpening on alternate strokes in the left and right slots. This avoids the disadvantages with other abrasives which tend to load-up unevenly with sharpening debris and with the result of one facet sharpening faster than the other. Where one facet is larger than the other and the edge is not centered on the blade thickness, the edge is unevenly supported and the blade will not cut straight but by will veer off to one side when cutting. Additionally, the edge life is shortened. Edges last longer where the facets are formed equally and of equal size.

The abrasive surface preferably is planar but it was found that specially shaped surfaces can be an advantage with some blades and cutting edge facets. For example, conically shaped abrasives proved convenient and effective with scissors as described in parent application Ser. No. 636,399 now U.S. Pat. No. 5,148,634.

Figure 10:
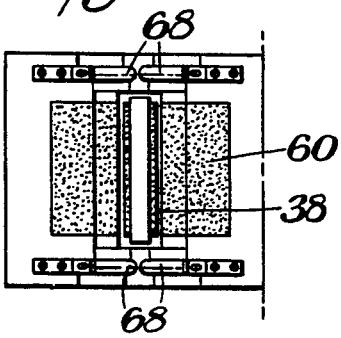
FIG. 10 is a top plan view of yet another form of sharpener in accordance with this invention.
Figure 11:
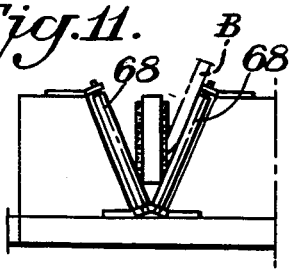
FIG. 11 is a side elevational view of the sharpener shown in FIG. 10.

FIGS. 10–11 illustrate a further feature of this invention which involves the use of rollers 68 on the guide surface outwardly of the abrasive surface 38. Rollers 68 provide a surface over which the blade B can roll at each end of the guide plane. Rollers 68 serve as low friction guides and by their position establish the position of the guide plane. The blade rolls over the circumference of the rollers and the face of the rest of the guide surface. The guide surface, such as the ferromagnetic plate, is preferably exactly in the same plane as the circumference of the rollers on which the blade face rolls or that face is located a few thousandths of an inch below that plane. Accordingly, the rollers function as low friction surfaces and when a magnetic system is used it can be attracting the blade while not actually rubbing against the blade causing friction and scratches. The rollers can be made of any suitable materials such as metal, plastic or metal covered with plastic or a plastic sleeve. The rollers are preferably elongated so as to provide a continuous support surface for the moving blade B.

Although FIGS. 10–11 illustrate rollers in conjunction with the magnetic guide surface 60 it is to be understood that the rollers may also be used in addition to spring hold down means with or without a magnetic guide surface. The rollers can be used with either stationary or moving abrasives.

Figure 15:
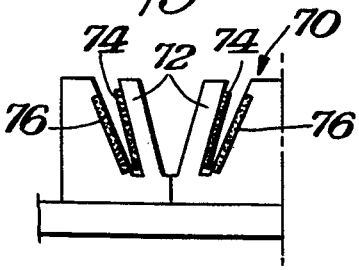
FIG. 15 is a cross-sectional view in elevation of yet another form of sharpening station in accordance with this invention.

Although in the preferred practice of this invention the abrasive particles 38 are mounted on opposite faces of a common sharpening member 36, the sharpening means may take other forms. FIG. 15, for example, illustrates a sharpening assembly 70 to include a pair of separate sharpening members 72,72 which for operator convenience are mounted at an angle to each other. An abrasive coating 74 is provided on each remote face of members 72,72. A suitable guide surface 76 would be disposed at a predetermined angle to the inclined sharpening member 72 for creating the proper cutting edge facet angle. If desired the two sharpening members could abut (or be spaced from) each other without being inclined.

In order to maximize the sharpening action it is preferable to use more than one sharpening station. Each sharpening station would differ from its adjacent sharpening station by the predetermined angle at which the guide surface is disposed and by which the angle intersects the planar abrasive coated face. The various stations would in general be arranged so that there are progressively larger angles for successive stations. Where a three stage sharpener is utilized the angles may be of the magnitude described in the above indicated parent patents and applications. Alternatively, the three bevels of the facets resulting on the blade edge may be angled 40°, 45° and 50° plus or minus 5° in a three stage sharpener. Additionally, where multiple stage sharpening sections are used it is also preferable to have the abrasive particles of grit sizes differing from the grit sizes of adjacent stations. In any of these configurations optimum performance is obtained using diamonds as abrasives.

What is claimed is:

1. A portable manual sharpener for sharpening the cutting edge facet of a blade of a cutting tool comprising a base, a first stage sharpening section mounted to said base, said first stage sharpening section including a support means having a pair of oppositely disposed faces, abrasive particles on each of said faces to comprise a sharpening surface on each of said faces, a pair of symmetrical slots formed in said first stage sharpening section with each of said slots being disposed toward a respective one of said sharpening surfaces, guide means mounted in each of said slots, each of said guide means including a guide surface adjacent to a respective sharpening surface and in a plane disposed at a predetermined angle to and intersecting its respective sharpening surface, said predetermined angle being the same for both of said guide surfaces, an elongated roller disposed laterally beyond each end of each of said sharpening surfaces, and said rollers having a circumference with a blade contacting surface generally coplanar with said plane of said guide surface at said predetermined angle to said sharpening surface for cooperating with said guide surface in guiding the blade into contact with said sharpening surface as the blade is moved across said sharpening surface in contact with said rollers and said guide surface.

2. The sharpener of claim 1 wherein said support means is stationary, and said base includes a portion for being hand held.

3. The sharpener of claim 2 wherein said hand held portion is a handle, said handle being mounted to said base generally perpendicularly to said slots of said sharpening section.

4. The sharpener of claim 1 including blade hold down means at each of said guide surfaces, and said hold down means being magnetic means.

5. The sharpener of claim 4 wherein each of said magnetic hold down means is a bi-level magnet.

6. The sharpener of claim 1 including blade hold down means at each of said guide surfaces, and said hold down means being spring means.

7. The sharpener of claim 6 wherein said spring means comprises a leaf spring mounted laterally beyond each end of said sharpening surface.

8. The sharpener of claim 1 wherein said support means is stationary, and said abrasive particles are diamonds.

9. The sharpener of claim 1, wherein said support means comprises a stationary first support means, the sharpener further including a second stage sharpening section having a second stationary support means with planar sharpening surfaces and having guide means in a second pair of slots with each of said second set of slots being at the same predetermined angle as each other but with said predetermined angle of said second stage sharpening section differing from said predetermined angle of said first stage sharpening section.

10. The sharpener of claim 9 wherein said sharpening surfaces in each of said first sharpening section and said second sharpening section are a pair of oppositely disposed planar faces on a sharpening member in each of said sharpening sections, said sharpening members being mounted to a common base parallel to each other.

11. The sharpener of claim 4 wherein said magnetic means is detachably mounted in said sharpening section.

12. The sharpener of claim 1 wherein said support means includes a stationary sharpening member having a pair of oppositely disposed parallel planar faces, and said sharpening member being detachably mounted in said sharpening section.

13. The sharpener of claim 1 wherein said support means comprises two stationary sharpening members having remote planar faces which comprise said sharpening surfaces.

14. The sharpener of claim 13 wherein said planar forces are at a non-parallel angle to each other.

15. A portable manual sharpener for sharpening the cutting edge facet of a blade of a cutting tool comprising a base, a first stage sharpening section mounted to said base, said first stage sharpening section including a support means having a pair of oppositely disposed faces, abrasive particles on each of said faces to comprise a sharpening surface on each of said faces, a pair of symmetrical slots formed in said first stage sharpening station with each of said slots being disposed toward a respective one of said sharpening surfaces, guide means mounted at each of said slots, each of said guide means including a guide surface adjacent to a respective sharpening surface and in a plane disposed at a predetermined angle to and intersecting its respective sharpening surface, said predetermined angle being the same for both of said guide surfaces, said guide means including an elongated roller disposed laterally beyond each end of each of said sharpening surfaces, and said rollers having an axis at said predetermined angle and a circumference with a blade contacting surface at said predetermined angle to said sharpening surface for guiding the blade into contact with said sharpening surface as the blade is moved across said sharpening surface in contact with said rollers.

16. A portable manual sharpener for sharpening the cutting edge facet of a blade of a cutting tool such as a knife or the like comprising a flat planar base having a pair of ends, a dividing plate perpendicularly mounted to said base between said ends of said base to form a handle section on one side of said plate and an operating section on the other side of said plate, an L-shaped handle mounted to said plate at a location spaced from base and mounted to said base at one of said ends to form an open space between said handle and said base whereby said handle may be grasped by a user to stabilize said sharpener during use, said operating section having a first sharpening station and an aligned second sharpening station, each of said sharpening stations having a stationary support member mounted perpendicularly and across said base, said support members being parallel to each other, each of said support members having an exposed face on each of the two opposite sides of said support member, abrasive particles stationarily mounted on said exposed faces of each of said support members to form a flat planar non-movable sharpening surface on each of said exposed faces whereby each of said support members comprises a stationary sharpening member, a pair of symmetrical slots angularly formed in each of said sharpening stations, each of said slots being disposed adjacent to and spaced from a respective one of said sharpening surfaces, guide means mounted in each of said slots, each of said guide means including a guide surface in a plane disposed at a predetermined angle to and intersecting its respective sharpening surface, said predetermined angle being the same for both of said guide surfaces in each of said sharpening stations, said angle in said first sharpening station differing from said angle in said second sharpening station to create a compound angle at the cutting edge facet when the blade is sharpened in both said first sharpening station and said second sharpening station, and magnetic blade hold down means at each of said guide surfaces for maintaining the blade in contact with said guide surface as said blade is moved through each of said slots with the cutting edge facet in sliding contact with each of said sharpening surfaces.

17. The sharpener of claim 1 wherein said faces are nonplanar.

* * * * *